US010837746B2

(12) United States Patent
Whitehead

(10) Patent No.: US 10,837,746 B2
(45) Date of Patent: Nov. 17, 2020

(54) AMMUNITION CASE ROLL SIZER APPARATUS

(71) Applicant: Kevin Gerald Whitehead, Roleystone (AU)

(72) Inventor: Kevin Gerald Whitehead, Roleystone (AU)

(73) Assignee: Kevin Gerald Whitehead, Roleystone (AU)

( * ) Notice: Subject to any disclaimer, the term of this patent is extended or adjusted under 35 U.S.C. 154(b) by 189 days.

(21) Appl. No.: 16/306,498

(22) PCT Filed: Jun. 28, 2018

(86) PCT No.: PCT/AU2018/050666
§ 371 (c)(1),
(2) Date: Nov. 30, 2018

(87) PCT Pub. No.: WO2019/000044
PCT Pub. Date: Jan. 3, 2019

(65) Prior Publication Data

US 2020/0309495 A1 Oct. 1, 2020

(30) Foreign Application Priority Data

Jun. 30, 2017 (AU) ..... 2017902544
Aug. 28, 2017 (AU) ..... 2017903472

(51) Int. Cl.
*F42B 33/10* (2006.01)
*F42B 33/00* (2006.01)

(52) U.S. Cl.
CPC ..... *F42B 33/10* (2013.01); *F42B 33/002* (2013.01)

(58) Field of Classification Search
CPC ..... F42B 33/10; F42B 33/00; F42B 33/001; F42B 33/002; F42B 33/004
(Continued)

(56) References Cited

U.S. PATENT DOCUMENTS 2,615,556 A * 10/1952 Hoopes ..... B65G 47/1428 198/389
4,389,867 A * 6/1983 Whitlock ..... B21D 3/14 72/121
(Continued)

OTHER PUBLICATIONS

International Search Report dated Sep. 20, 2018, Authorized Officer: Chuong Nguyen-Kim.

*Primary Examiner* — John Cooper
(74) *Attorney, Agent, or Firm* — Winstead PC

(57) ABSTRACT

Provided is an ammunition case roll sizing apparatus 10 which comprises a base 12 which typically defines a surface 14 along with a case receptacle 16 proximate the surface 14. The base 12 also includes a former 18 protruding from a boundary of the surface 14. The apparatus 10 further comprises a circular disk 20 which is rotatably flat mounted onto the surface 14 of the base 12 so that a case channel 22 is complementarily defined between the disk 20 and the former 18. The disk 20 is operatively rotatable via a rotational actuator 24. Also included is a case feeder 26 configured for operatively receiving a plurality of cases 28 and for feeding a case lengthwise into the case receptacle 16 of the base. Further included is a case pusher 30 which is configured to be operatively actuatable by the rotating disk 20 in order to push a case 28 from the case receptacle 16 into the channel 22 to roll-size the case.

20 Claims, 5 Drawing Sheets

(58) Field of Classification Search
USPC ..... 86/19, 19.5, 19.6, 19.7, 23, 25, 26, 27, 86/28, 45, 46
See application file for complete search history.

(56) References Cited

U.S. PATENT DOCUMENTS 4,455,915 A * 6/1984 Ransom ..... F42B 33/002 86/26
4,563,935 A * 1/1986 Rinck ..... F42B 33/002 198/478.1
4,893,542 A * 1/1990 Aluotto ..... F42B 33/14 102/435
5,515,766 A * 5/1996 Fleury ..... F42B 33/10 72/90
6,192,561 B1 * 2/2001 Bennett ..... B21D 41/04 72/118
7,770,503 B2 * 8/2010 de Almeida ..... F42B 33/00 86/25

* cited by examiner

AMMUNITION CASE ROLL SIZER APPARATUS

TECHNICAL FIELD

This invention relates to the field of small arms ammunition, in general, and more particularly to a roll sizer apparatus for ammunition cases, an associated method of roll sizing ammunition cases, and a method of reloading ammunition cases.

BACKGROUND ART

The following discussion of the background art is intended to facilitate an understanding of the present invention only. The discussion is not an acknowledgement or admission that any of the material referred to is or was part of the common general knowledge as at the priority date of the application.

As is known in the field of firearms, particularly small arms, a cartridge is a type of ammunition generally packaging a bullet, a propellant substance (usually either smokeless powder or black powder) and a primer within a metallic case or casing that is precisely made to fit within the firing chamber of a firearm. After firing in a suitable firearm, the bullet is propelled out of the case by explosive expansion of the propellant following ignition thereof by the primer, with the case then ejected from the breech of the firearm.

These cartridge cases are generally manufactured from brass and form a large proportion of the cost of a cartridge. However, with proper maintenance, such cases can typically be reused many times in a practice known as reloading.

Reloading is the process of loading firearm cartridges by assembling the individual components (case, primer, powder, and bullet), rather than purchasing completely assembled, factory-loaded ammunition. Economy, increased accuracy, performance, customisability, commercial ammunition shortages, and hobby interests are all common motivations for reloading of cartridges.

The steps in reloading are generally recovering or obtaining spent brass cases, cleaning the brass to remove any dirt or stains, resizing the case and removing the spent primer, installing a new primer, placing a new powder charge in the case, seating a new bullet and crimping the case around the bullet.

As a result, the resizing of spent cases is vitally important to ensure that the brass used is uniform and consistent in shape. Depending on where and how the brass cases are sourced, many brass suppliers are shooting ranges who offer 'once fired' cases to reloaders. These cases are often used in a variety of firearms and are deformed to varying degrees, some excessively due to the characteristics of specific firearms. It is very difficult to visually inspect the brass cases and determine case stretch or deformation.

For example, a number of firearms designed for military or police use are designed specifically for reliability and as such the tolerances particularly in the barrel chamber are loose and, upon firing, the spent case is stretched significantly beyond what would occur for other competition specific firearms. The stretched cases cannot be reshaped easily for reloading and need to be sized to remove the bulge in the brass before reloading. Such sizing of cases is generally done to reshape the cases to remove case bulge or stretch.

A number of methods have been developed to resize brass cases, but these often require large and expensive machinery and/or have limitations with regard to quality and practicality, generally making them available only to large-scale resizing operations. As such, the Applicant has identified a need for an inexpensive case sizing apparatus with the ability to resize a large volume of cases without requiring manual input, and that is able to accommodate a variety of case calibres.

The current invention was conceived with these shortcomings in mind in an attempt to ameliorate, at least in part, some of the shortcomings in the art of ammunition case roll sizing.

SUMMARY OF THE INVENTION

The skilled addressee will appreciate that reference herein to a cartridge case is made in a non-exclusive manner and that a bullet of a cartridge may also be subject to roll sizing as described herein, either individually or in combination with a case, depending on requirements.

According to a first aspect of the invention there is provided an ammunition case roll sizing apparatus comprising:

a base defining a surface and a case receptacle proximate the surface, and having a former protruding from a boundary of said surface;

a circular disk rotatably flat mounted onto the surface of the base so that a case channel is complementarily defined commencing from the case receptacle between the former and the disk being operatively rotatable via a rotational actuator;

a case feeder configured for operatively receiving a plurality of cases and for operatively feeding a case lengthwise into the case receptacle; and a case pusher configured to be operatively actuatable by the rotating disk to push a case from the case receptacle into the channel, wherein rotation of the disk urges said case through the channel to roll-size the case.

Typically, the base comprises a second circular disk with a larger diameter than the circular disk and defining an off-centre axial aperture therein for receiving an axis of the circular disk.

Typically, the surface is defined about the off-centre axial aperture to facilitate rotatable flat mounting of the circular disk onto the base.

Typically, the former comprises a tapered protrusion along a sector of the second circular disk so that the complementarily formed case channel has a gradually diminishing diameter to facilitate roll sizing of a case traversing therethrough.

Typically, respective radii of the circular disk and the second circular disk are selected so that a length of the case channel is in the range of 50 mm to 250 mm.

Preferably, the case channel has a length of between 150 mm and 200 mm.

Typically, the case receptacle comprises a flat surface defined on a distal edge of the second circular disk relative to the off-centre axial aperture.

Typically, the case receptacle comprises urging means configured to complementarily urge a received case with the case pusher into the case channel.

In one example, the urging means comprises a flat spring arrangement configured to urge the case towards the case pusher.

Typically, the rotational actuator comprises a motor. The motor may include a gearbox.

Typically, the case feeder is configured to feed the cases into the case receptacle under the influence of gravity.

Alternatively, the apparatus may include an actuator for feeding the cases into the case receptacle.

Typically, the case feeder is configured to feed a case lengthwise onto the case receptacle.

Typically, the case feeder comprises a flexible feeding tube with a diameter slightly larger than a case in order to feed a case lengthwise onto the case receptacle.

Typically, the base includes an adjustable tube mount for mounting the feeding tube above the case receptacle, said tube mount height-adjustable over the case receptacle for accommodating various case lengths.

Typically, the case pusher comprises an upper surface and a lower arcuate finger, the upper surface pivotably flat-mountable onto an upper surface of the former so that oscillation of the case pusher swings the arcuate finger into and towards, or out of and away from, the case receptacle and case channel, respectively.

Typically, the case pusher facilitates feeding of cases from the case feeder into the receptacle by the tube mount mounting the feeding tube over the arcuate finger, oscillation of the case pusher allowing a single case to exit the feeding tube and enter the case receptacle when said arcuate finger swings out underneath the feeding tube whilst blocking the feeding tube when the arcuate finger swings underneath said feeding tube.

Typically, the arcuate finger of the case pusher pushes a case from the case receptacle into the channel.

Typically, oscillation of the case pusher is actuatable by the rotating disk.

Typically, the case pusher includes a lever operatively actuatable by at least one lever on the rotating disk, said case pusher lever configured to interact with a disk lever to actuate through one oscillation.

Typically, the disk comprises a plurality of levers for actuating the case pusher a plurality of times per rotation of the circular disk.

Typically, interaction between the case pusher lever and a disk lever swings the arcuate finger toward the case channel.

Typically, the case pusher includes a biasing means for biasing the arcuate finger away from the case channel.

Typically, the apparatus includes a collector for collecting the roll-sized cases exiting the channel.

In one example, the collector comprises a collection chute positioned proximate the base at an exit of the case channel.

In one example, the circular disk defines a particular profile comprising, as the disk rotates on the base, a case recess followed by a blocking protrusion with subsequent increasing radius so that the case channel has a gradually diminishing diameter to facilitate roll sizing of a case traversing therethrough, whilst the blocking protrusion impedes the case feeder feeding a case into the case receptacle.

Typically, the particular profile of the circular disk includes a protrusion proximate said case recess to facilitate expulsion of a roll sized case from the apparatus and to prevent a case from travelling through the case channel a second time as the disk rotates on the base.

According to a second aspect of the invention there is provided a method for roll sizing ammunition cases, said method comprising the steps of:

providing an ammunition case roll sizing apparatus comprising a base defining a surface and a case receptacle proximate the surface, and having a former protruding from a boundary of said surface; a circular disk rotatably flat mounted onto the surface of the base so that a case channel is complementarily defined commencing from the case receptacle between the former and the disk being operatively rotatable via a rotational actuator; a case feeder configured for operatively receiving a plurality of cases and for feeding a case lengthwise into the case receptacle; and a case pusher configured to be operatively actuatable by the rotating disk to push a case from the receptacle into the channel, wherein rotation of the disk urges said case through the channel to roll-size the case; and loading at least one case into the case feeder for operative feeding into the case receptacle; and actuating the circular disk to roll-size the case through the case channel.

According to a third aspect of the invention there is provided a method for roll sizing ammunition cases, said method comprising the steps of:

providing an ammunition case roll sizing apparatus in accordance with the first aspect of the invention;

loading at least one case into the case feeder for operative feeding into the case receptacle; and actuating the circular disk to roll-size the case through the case channel.

According to a fourth aspect of the invention there is provided a method for reloading ammunition cartridge cases, said method comprising the steps of:

roll-sizing a case using an ammunition case roll sizing apparatus in accordance with the first aspect of the invention;

reloading said roll-sized case with a propellant and seating a bullet therein; and crimping said case to secure the propellant and bullet.

BRIEF DESCRIPTION OF THE DRAWINGS

The description will be made with reference to the accompanying drawings in which.

DETAILED DESCRIPTION OF EMBODIMENTS

Figure 1:
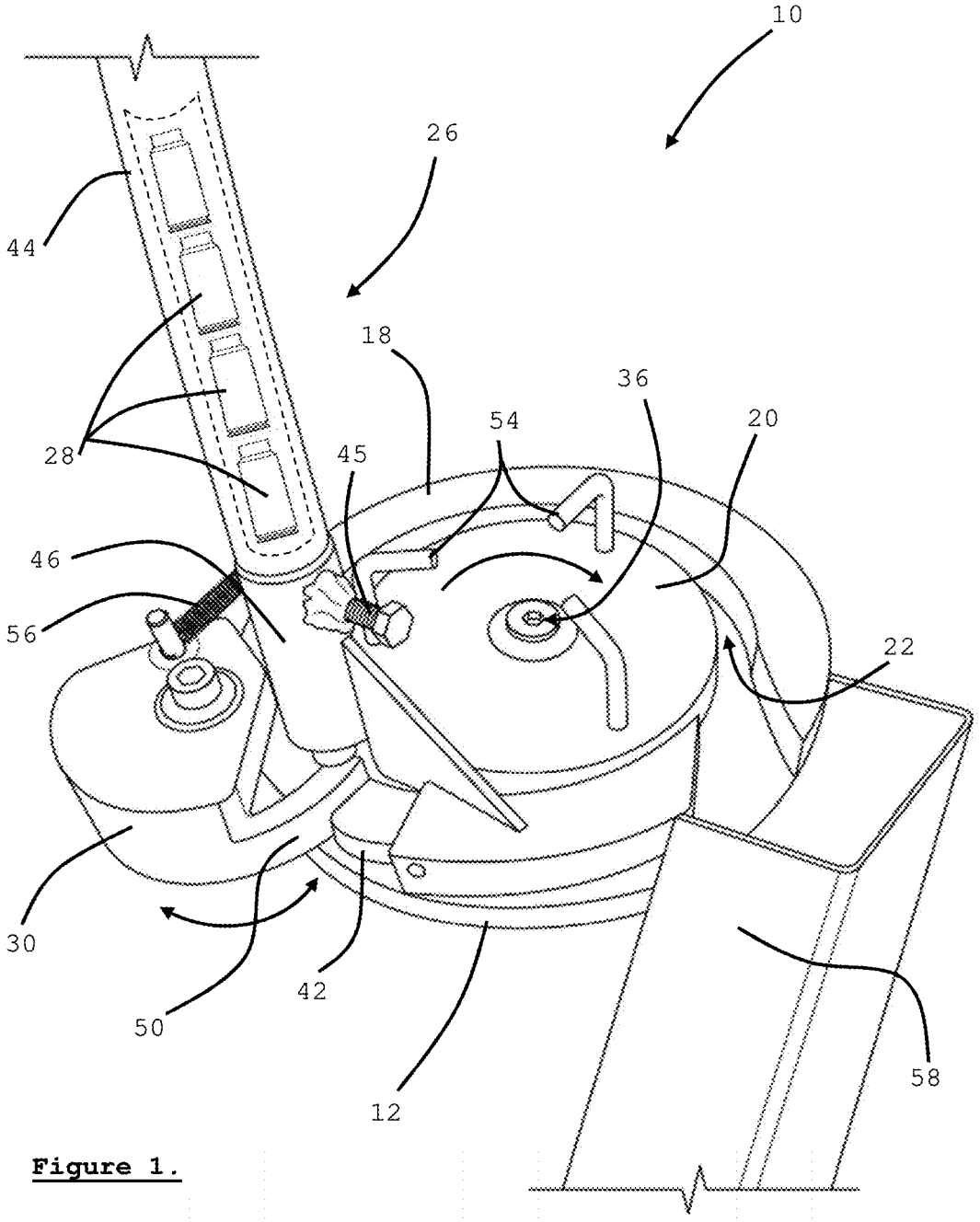
FIG. 1 is a perspective-view diagrammatic representation of one example of an ammunition case roll sizing apparatus, in accordance with one aspect of the invention.
Figure 2:
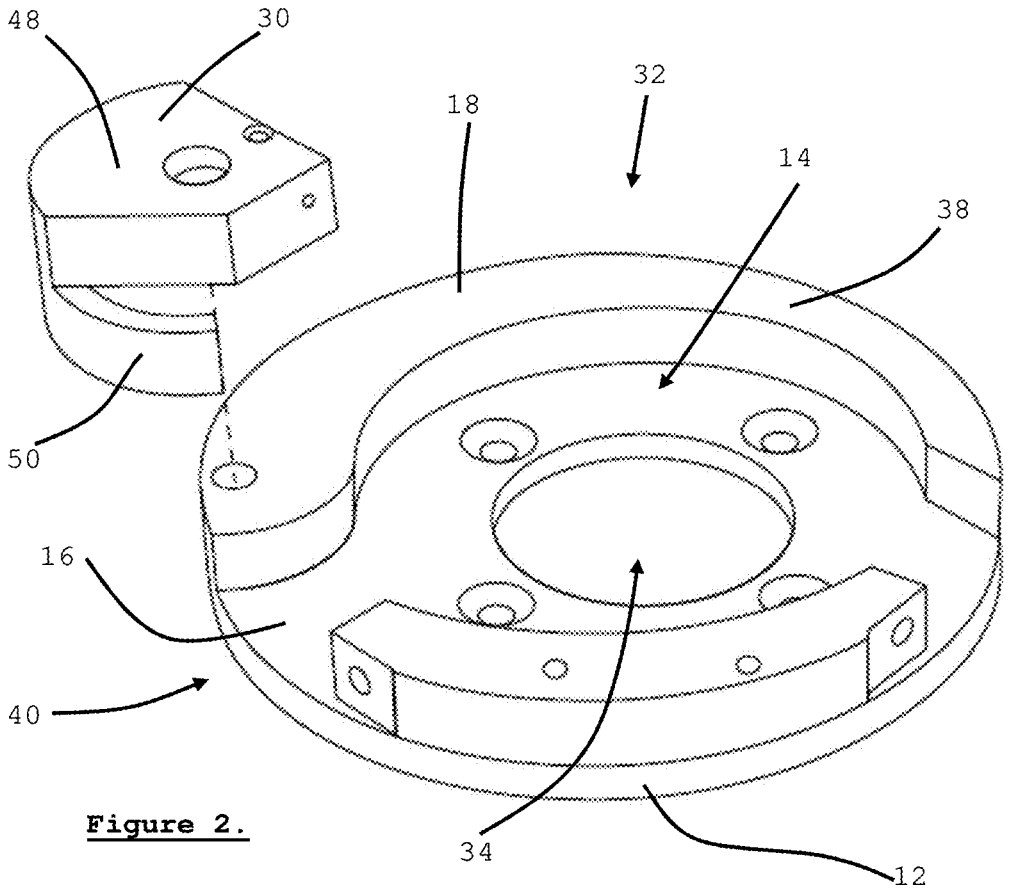
FIG. 2 is a perspective exploded view diagrammatic representation of a base and case pusher of the apparatus of FIG. 1.
Figure 3:
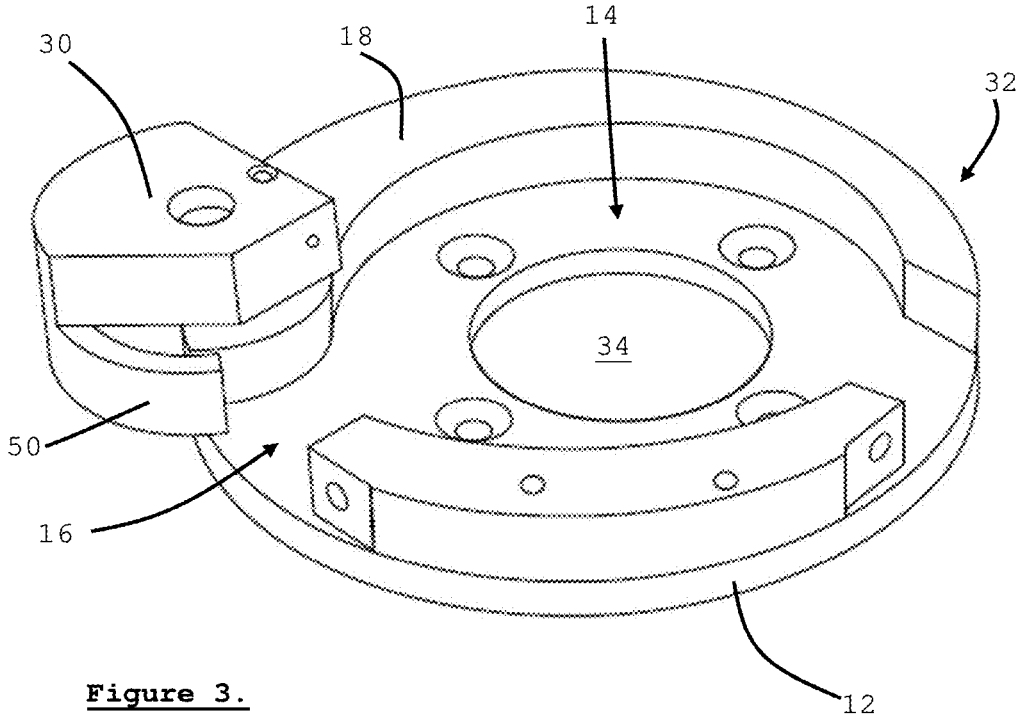
FIG. 3 is perspective-view diagrammatic representation of the case pusher mounted to the base of FIG. 2.

Further features of the present invention are more fully described in the following description of several non-limiting embodiments thereof. This description is included solely for the purposes of exemplifying the present invention to the skilled addressee. It should not be understood as a restriction on the broad summary, disclosure or description of the invention as set out above. In the figures, incorporated to illustrate features of the example embodiment or embodiments, like reference numerals are used to identify like parts throughout.

With reference now to the accompanying drawings, there is shown one example of an ammunition case roll sizing apparatus 10. As described herein, apparatus 10 finds particular application in roll sizing small arms ammunition cartridge cases or even bullets, depending on requirements. In general, the apparatus 10 comprises a base 12 which typically defines a surface 14 along with a case receptacle 16 proximate the surface 14. The base 12 also includes a former 18 protruding from a boundary of the surface 14, as shown.

The base 12 and former 18 are typically manufactured from a rigid and generally unyielding material, such as a metal, to facilitate compressive roll sizing of cartridge cases and/or bullets.

The apparatus 10 further comprises a circular disk 20 which is rotatably flat mounted onto the surface 14 of the base 12 so that a case channel 22 is complementarily defined between the disk 20 and the former 18. The case channel 22 generally commences from the case receptacle 16. The disk 20 is operatively rotatable via a rotational actuator 24, such as an electric or internal combustion motor with or without a suitable gearbox, a hand crank mechanism, and/or the like, as required. Other types and configurations of actuators are possible, as will be understood by the skilled addressee. The disk 20 is also typically manufactured from a rigid and generally unyielding material, such as a metal, to facilitate compressive roll sizing of cartridge cases and/or bullets.

Apparatus 10 also generally includes a case feeder 26 configured for operatively receiving a plurality of cases 28, as shown. The case feeder 26 is typically configured to feed a single case 28 lengthwise into the case receptacle 16 of the base 12. As will become apparent below, such upright feeding is important to allow proper roll-sizing via apparatus 10. However, one particular advantage of apparatus is the ability roll-size cases in either orientation lengthwise, i.e. upright or upside down.

Further generally included in apparatus 10 is a case pusher 30 which is configured to be operatively actuatable by the rotating disk 20 in order to push a case 28 from the case receptacle 16 into the channel 22. In this manner, rotation of the disk 20 operatively urges the case 28 through the case channel 22 to roll-size the case.

In the current example, the base 12 typically comprises a second circular disk 32 having a larger diameter than the rotatable circular disk 20, as shown. However, the skilled addressee will appreciate that other configurations are possible and within the scope of the current invention. The second disk 32 of the base 12 typically defines an off-centre axial aperture 34 therein for receiving an axis 36 of the circular disk 20. The surface 14 of the base 12 is typically defined about the off-centre axial aperture 34 in order to facilitate rotatable flat mounting of the circular disk 20 onto the base 12.

The former 18 typically comprises a tapered protrusion 38 running along a sector of the second circular disk 32 of the base 12, so that the complementarily formed case channel 22 has a gradually diminishing diameter to facilitate roll sizing of a case traversing through the channel, in use. The skilled addressee will appreciate that various configurations around the shape and dimensions of the former 18 are possible and within the scope of the current invention. It is further to be appreciated that such diminishing diameter of the case channel 22 is typically very gradual to allow for suitably roll-sizing of a case 28.

In one example, the respective radii of the circular disk 20 and the second circular disk 32 of the base 12 are selected to that a length of the case channel 22, with suitable former 18 configuration, is in the range of 50 mm to 300 mm. In a preferred embodiment, the case channel 22 has a length of between 150 mm and 200 mm, e.g. 180 mm or the like. Other variations are possible and within the scope of the invention, as will be appreciated by the skilled addressee. Advantageously, a diameter and associated characteristics of the case channel 22 can be easily altered by replacing or swapping between circular disks 20 of different radius.

In one example, a radius of the circular disk 20 may be 50 mm, with other examples seeing a radius of 75 mm, or the like. The skilled addressee will appreciate that various different diameters and configurations for the disk 20 are possible and may depend on requirements such as required or desired mechanical effort required to rotate disk 20, typically depending on apparatus 10 being configured to have a manually rotatable disk 20, a motor (internal combustion or electromechanical) rotating the disk, etc.

In the present example, the case receptacle 16 generally comprises a flat surface defined on a distal edge 40 of the second circular disk 32 relative to the off-centre axial aperture 34, as shown. Such distal placement generally allows for real estate on the base for the case receptacle 16 and for mounting the case pusher 30, as described below.

In addition, one example of the apparatus 10 comprises the case receptacle 16 including some manner of urging means 42 which is configured to complementarily urge a received case along with the case pusher 30 into the case channel 22. In the current example, such urging means 42 comprises a flat spring arrangement which is configured to urge the case towards the case pusher 30. However, other configurations are possible, e.g. guiding channels, electromechanical guiding means, etc., as will be understood by the skilled addressee.

In this example, the case feeder 26 is generally configured to feed the cases 28 into the case receptacle 16 under the influence of gravity, but other embodiments may feature the apparatus 10 having an actuator or suitable urging means for feeding the cases 28 into the case receptacle 16. As described above, the case feeder 26 is typically configured to feed a case 28 lengthwise into the case receptacle 16. In the present example, the case feeder 26 comprises a flexible feeding tube 44 having a diameter slightly larger than a case 28 in order to feed a case 28 lengthwise into the case receptacle 16, as described.

To this end, the base 12 includes an adjustable tube mount 46 for mounting the feeding tube 44 above the case receptacle 16, as shown. The tube mount 44 is generally height-adjustable via adjuster 45 over the case receptacle 16 in order to allow for accommodating various case lengths, as described in more detail below. The tube mount 44 typically incorporates a solid tube (not shown) configured to accommodate flexible tube 44 therein, said adjuster 45 operatively urging against such solid tube to retain tube 44 in position.

Figure 5:
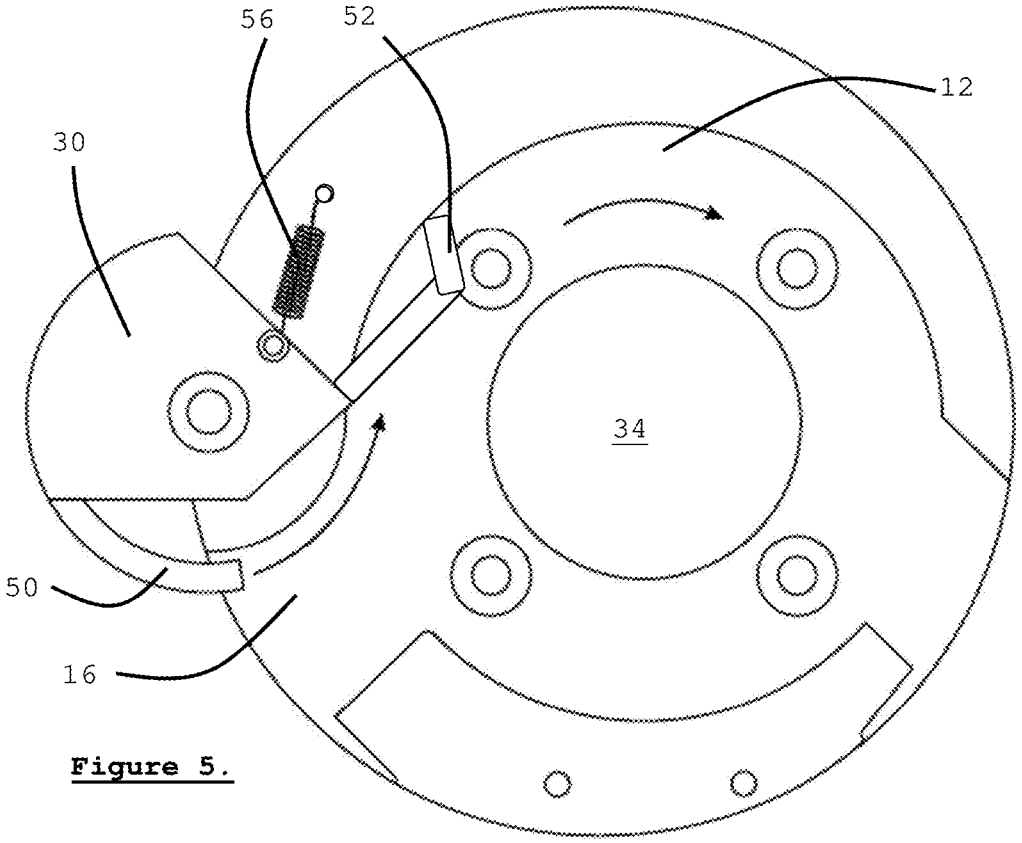
FIG. 5 is a further top-view diagrammatic representation of the base and case pusher of the apparatus of FIG. 1.
Figure 6:
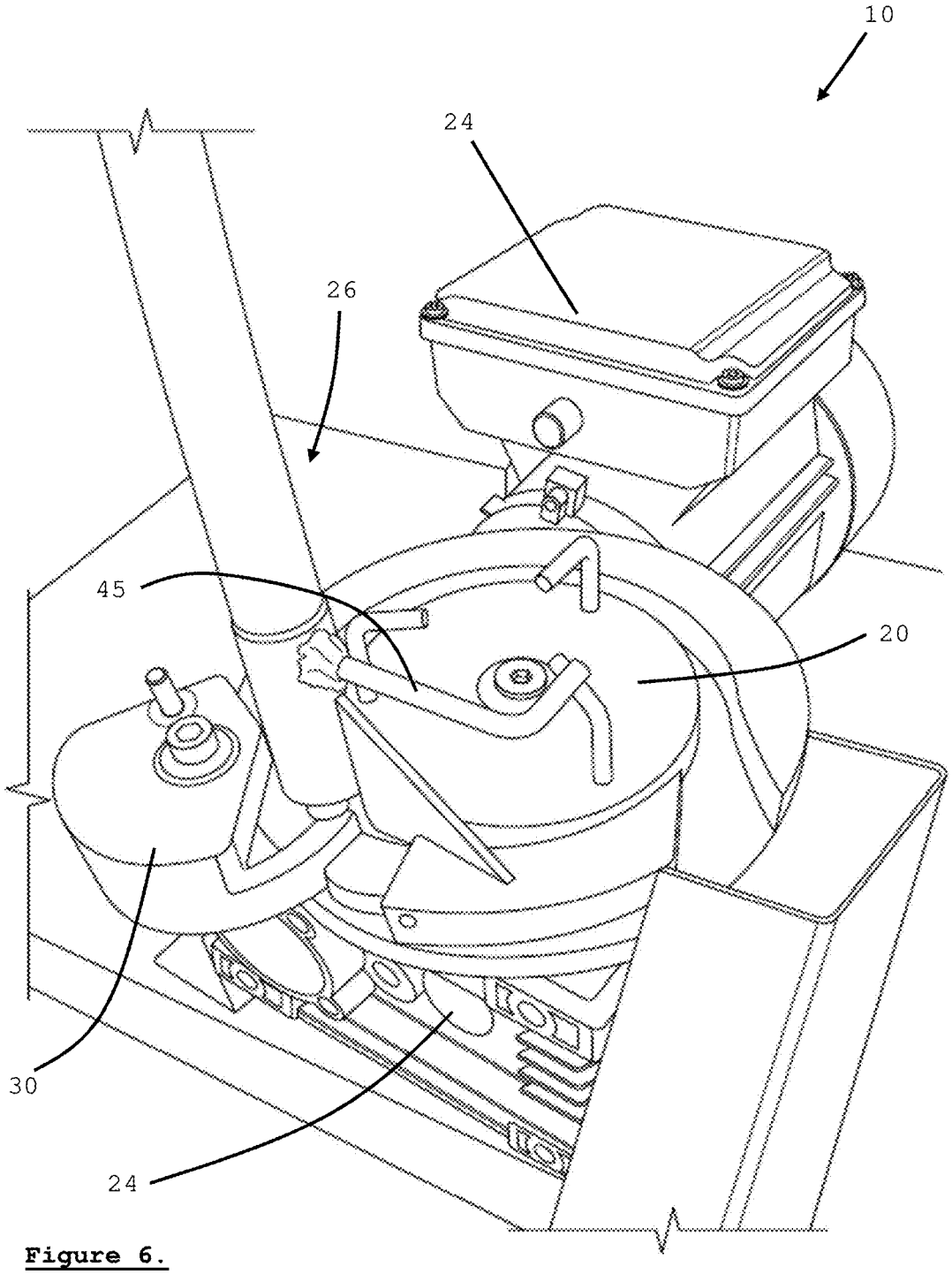
FIG. 6 is a perspective-view diagrammatic representation of the apparatus of FIG. 1 showing a suitable actuator.

In the current example, the case pusher 30 comprises an upper surface 48 and a lower arcuate finger 50, as shown. The upper surface 48 is pivotably flat-mountable onto an upper surface of the former 18, as shown, so that oscillation of the case pusher 30 swings the arcuate finger into and towards, or out of and away from, the case receptacle 16 and case channel 22, respectively, as shown in FIG. 5.

In addition, the case pusher 30 of the present example facilitates in feeding cases 28 from the case feeder 26 into the case receptacle 16 by the tube mount 46 mounting the feeding tube 44 over the arcuate finger 50, whereby oscillation of the case pusher 30 allows a single case to exit the feeding tube 44 and enter the case receptacle 16 when the arcuate finger 50 swings out from underneath the feeding tube 44. Similarly, the arcuate finger 50 blocks the feeding tube 44 when said arcuate finger 50 swings underneath the feeding tube 44. In this manner, the arcuate finger 50 of the case pusher 30 is able to push a case from the case receptacle 16 into the channel 22, whilst simultaneously regulating or controlling the feeding of cases from the feeding tube 44 one at a time.

Figure 4:
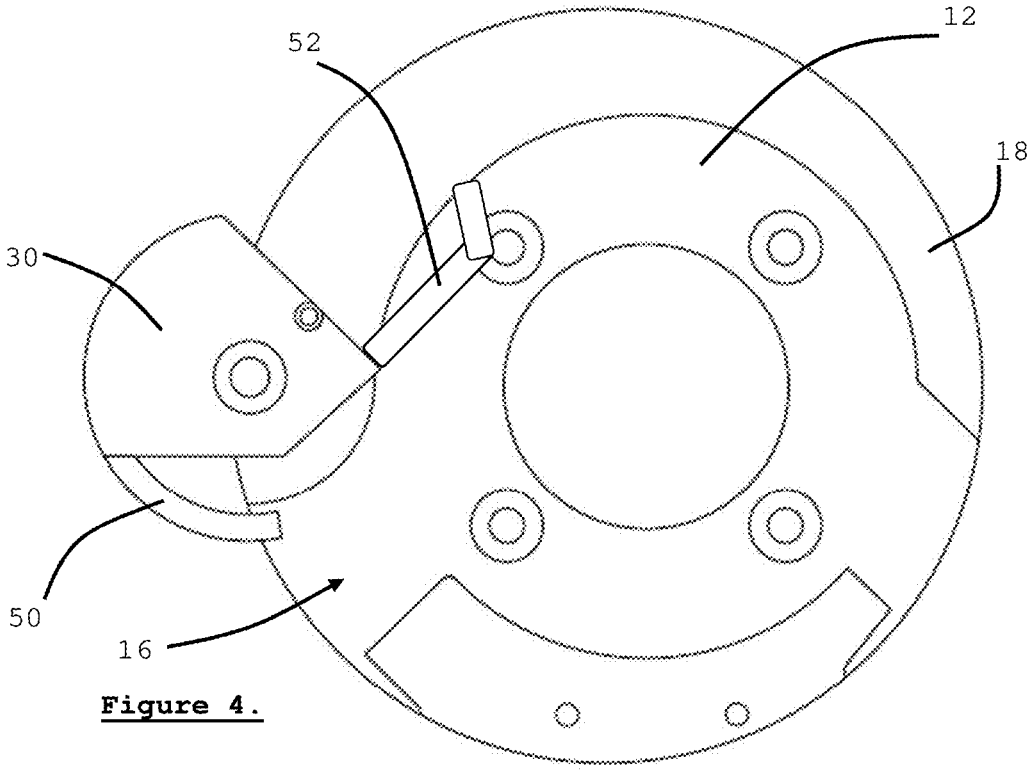
FIG. 4 is a top-view diagrammatic representation of the base and case pusher of the apparatus of FIG. 1.

In general, oscillation of the case pusher 30 is actuatable by the rotating disk 20. To this end, the case pusher 30 typically includes a lever 52 (a general example of which is shown in FIGS. 4 and 5) which can be operatively actuated by at least one lever 54 on the rotating disk 20. The case pusher lever 52 is generally configured to interact with the disk lever 54 to actuate through one oscillation, i.e. the arcuate finger 50 retracting to allow a single case into the case receptacle 16, after which the finger 50 pushes said case into the case channel 22.

In a preferred embodiment, the disk 20 comprises a plurality of levers 54 for actuating the case pusher 30 an associated plurality of times per single rotation of the circular disk 20. It is to be appreciated that interaction between the case pusher lever 52 and a disk lever 54 typically swings the arcuate finger 50 towards the case channel 22. In addition, the case pusher 30 generally includes a biasing means 56, such as a coil spring, or the like, for biasing the case pusher 30 and arcuate finger 50 away from the case channel 22, as shown.

Figure 7:
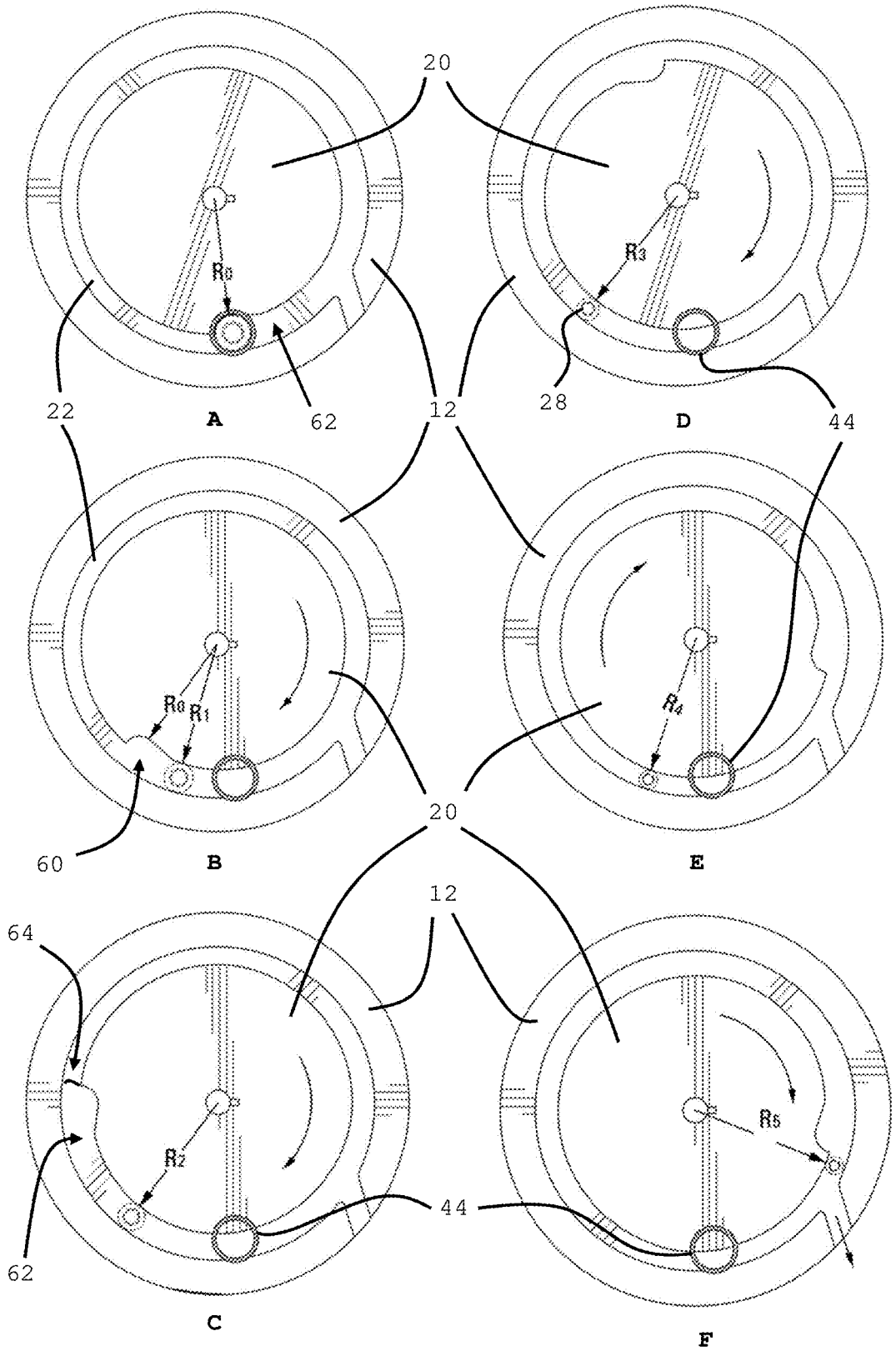
FIGS. 7 A-F are top-view diagrammatic representations of a further embodiment of the circular disk having a particular profile.

With reference now to FIG. 7 of the accompanying drawings, there is shown a further embodiment on the invention wherein the circular disk 20 defines a particular or specific profile. In this example, the circular disk defines a particular profile comprising, as the disk 20 rotates on the base 12, a case recess 60 followed by a blocking protrusion 62 with subsequent increasing radius so that the case channel 22 has a gradually diminishing diameter to facilitate roll sizing of a case 28 traversing therethrough, whilst the blocking protrusion 62 impedes the case feeder 26, typically the feeding tube 44, from feeding a case into the case receptacle.

Operation of the embodiment of FIG. 7 is indicated sequentially from figures A through F, respectively. As the disk 20 rotates on the base 22, the case recess 60 passes underneath feeding tube 44*m* said case recess shaped and dimensioned to allow a case to fall under the influence of gravity into the recess 60 (effectively becoming the case receptacle 16, as described above). As disk 20 rotates, the blocking protrusion 62 blocks the feeding tube 44 to prevent any further cases from exiting the tube 44.

Disk 20 has a gradually increasing diameter or radius R1 to R5, as indicated, so that the case channel 22 has a gradually diminishing diameter to facilitate roll sizing of the case 28 traversing therethrough, as shown. In other words, R1<R2<R3<R4<R5 in a typical example. For the sake of simplicity, the case is not shown as traversing through the channel 22, as will be appreciated by the skilled addressee.

In addition, the disk 20 shown in the example of FIG. 7 typically includes a protrusion 64 (shown in FIG. 7C) to facilitate expulsion of a roll sized case from apparatus 10 and to prevent a case from travelling through the case channel 22 a second time. Various configurations of the protrusion are possible and within the scope of the present invention, e.g. a spring, a lip, a hook, etc.

The skilled addressee will appreciate that variations on the exemplified configuration of the case pusher 30 are possible and within the scope of the invention. For example, the case pusher may comprise a regulated linear actuator, a hydraulic actuator, a pneumatic actuator, and/or the like.

The apparatus 10 also typically includes a collector 58 for collecting the roll-sized cases exiting the channel 22. In the current example, the collector 58 comprises a collection chute positioned proximate the base 12 at an exit of the case channel 22, as shown. Such a chute generally leads towards a suitable container for collecting the roll-sized cases. In one embodiment, the apparatus 10 also includes an ejection spring, or the like, positioned proximate the exit of the case channel 22 and configured to facilitate roll-sized cases from exiting apparatus 10.

It is to be appreciated that the invention also provides for an associated method for roll sizing ammunition cases. In general, this method comprises the steps of providing the ammunition case roll sizing apparatus 10, loading at least one case 28 into the case feeder 26 for operative feeding into the case receptacle 16, and actuating the circular disk 20 to roll-size the case through the case channel 22, as described above.

Similarly, the invention also provides for a method for reloading ammunition cartridge cases. This method typically comprises the steps of roll-sizing a case using the ammunition case roll sizing apparatus 10, reloading said roll-sized case with a propellant and seating a bullet therein, and crimping the case to secure the propellant and bullet.

Applicant believes it particularly advantageous that the apparatus 10 provides for accurate and reliable roll-sizing of ammunition cases. The apparatus 10 includes a flexible feeding tube 44 which allows for locating the apparatus 10 in convenient spaces, and it features a relatively small footprint whilst allowing for a high volume of cases to be reliably roll-sized. The apparatus 10 can be manufactured relatively inexpensive, and can be designed so that orientation of cases entering the case channel is irrelevant, i.e. upright or upside-down cases can be roll-sized. A further particular advantage is that the compact apparatus provides a relatively long rolling length through the channel to allow accurate roll-sizing of cases. The apparatus 10 can also accommodate a large variety of different calibres, and changing between different calibres generally involves simply changing the circular disk 20 to one having a different radius, which is easily done.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. As used herein, the term "and/or" includes any and all combinations of one or more of the associated listed items. No language in the specification should be construed as indicating any non-claimed subject matter as essential to the practice of the claimed subject matter.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise. Variations (e.g. modifications and/or enhancements) of one or more embodiments described herein might become apparent to those of ordinary skill in the art upon reading this application. The inventor(s) expects skilled artisans to employ such variations as appropriate, and the inventor(s) intends for the claimed subject matter to be practiced other than as specifically described herein.

Any method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. An ammunition case roll sizing apparatus comprising:

a base defining a surface and a case receptacle proximate the surface, and having a former protruding from a boundary of said surface;

a circular disk rotatably flat mounted onto the surface of the base so that a case channel is complementarily defined commencing from the case receptacle between the former and the disk being operatively rotatable via a rotational actuator;

a case feeder configured for operatively receiving a plurality of cases and for feeding a case lengthwise into the case receptacle; and a case pusher configured to be operatively actuatable by the rotating disk to push a case from the receptacle into the channel, wherein rotation of the disk urges said case through the channel to roll-size the case.

2. The apparatus of claim 1, wherein the base comprises a second circular disk with a larger diameter than the circular disk and defining an off-centre axial aperture therein for receiving an axis of the circular disk.

3. The apparatus of claim 2, wherein the surface is defined about the off-centre axial aperture to facilitate rotatable flat mounting of the circular disk onto the base.

4. The apparatus of claim 2, wherein respective radii of the circular disk and the second circular disk are selected so that a length of the case channel is in the range of 50 mm to 250 mm.

5. The apparatus of claim 2, wherein the case receptacle comprises a flat surface defined on a distal edge of the second circular disk relative to the off-centre axial aperture as well as urging means configured to complementarily urge a received case with the case pusher into the case channel.

6. The apparatus of claim 1, wherein the former comprises a tapered protrusion along a sector of the second circular disk so that the complementarily formed case channel has a diminishing diameter to facilitate roll sizing of a case traversing therethrough.

7. The apparatus of claim 1, wherein the case feeder is configured to feed the cases lengthwise into the case receptacle under the influence of gravity.

8. The apparatus of claim 1, wherein the case feeder comprises a flexible feeding tube with a diameter slightly larger than a case in order to feed a case lengthwise into the case receptacle, the base further including an adjustable tube mount for mounting the feeding tube above the case receptacle, said tube mount height-adjustable over the case receptacle for accommodating various case lengths.

9. The apparatus of claim 1, wherein the case pusher comprises an upper surface and a lower arcuate finger, the upper surface pivotably flat-mountable onto an upper surface of the former so that oscillation of the case pusher swings the arcuate finger into and towards, or out of and away from, the case receptacle and case channel, respectively.

10. The apparatus of claim 9, wherein the case pusher facilitates feeding of cases from the case feeder into the receptacle by the tube mount mounting the feeding tube over the arcuate finger, oscillation of the case pusher allowing a single case to exit the feeding tube and enter the case receptacle when said arcuate finger swings out underneath the feeding tube whilst blocking the feeding tube when the arcuate finger swings underneath said feeding tube, wherein the arcuate finger of the case pusher pushes a case from the case receptacle into the channel when the arcuate finger swings underneath said feeding tube.

11. The apparatus of claim 10, wherein oscillation of the case pusher is actuatable by the rotating disk.

12. The apparatus of claim 11, wherein the case pusher includes a lever operatively actuatable by at least one lever on the rotating disk, said case pusher lever configured to interact with a disk lever to actuate through one oscillation.

13. The apparatus of claim 12, wherein the disk comprises a plurality of levers for actuating the case pusher a plurality of times per rotation of the circular disk.

14. The apparatus of either of claim 12, wherein interaction between the case pusher lever and a disk lever swings the arcuate finger toward the case channel.

15. The apparatus of claim 9, wherein the case pusher includes a biasing means for biasing the arcuate finger away from the case channel.

16. The apparatus of claim 1, which includes a collector for collecting the roll-sized cases exiting the channel, the collector comprising a collection chute positioned proximate the base at an exit of the case channel.

17. The apparatus of claim 1, wherein the circular disk defines a particular profile comprising, as the disk rotates on the base, a case recess followed by a blocking protrusion with subsequent increasing radius so that the case channel has a gradually diminishing diameter to facilitate roll sizing of a case traversing therethrough, whilst the blocking protrusion impedes the case feeder feeding a case into the case receptacle.

18. The apparatus of claim 17, wherein the particular profile of the circular disk includes a protrusion proximate said case recess to facilitate expulsion of a roll sized case from the apparatus and to prevent a case from travelling through the case channel a second time as the disk rotates on the base.

19. A method for roll sizing ammunition cases, said method comprising the steps of:

providing an ammunition case roll sizing apparatus comprising a base defining a surface and a case receptacle proximate the surface, with a former protruding from a boundary of said surface; a circular disk rotatably flat mounted onto the surface of the base so that a case channel is complementarily defined commencing from the case receptacle between the former and the disk being operatively rotatable via a rotational actuator; a case feeder configured for operatively receiving a plurality of cases and for feeding a case lengthwise into the case receptacle; and a case pusher configured to be operatively actuatable by the rotating disk to push a case from the receptacle into the channel, wherein rotation of the disk urges said case through the channel to roll-size the case; and loading at least one case into the case feeder for operative feeding into the case receptacle; and actuating the circular disk to roll-size the case through the case channel.

20. A method for reloading ammunition cartridge cases, said method comprising the steps of:

roll-sizing a case using an ammunition case roll sizing apparatus in accordance with claim 1;

reloading said roll-sized case with a propellant and seating a bullet therein; and crimping said case to secure the propellant and bullet.

* * * * *